US009716301B2

(12) United States Patent
Park et al.

(10) Patent No.: US 9,716,301 B2
(45) Date of Patent: Jul. 25, 2017

(54) RADIO FREQUENCY FILTER HAVING A HOLLOW BOX WITH A WRINKLE STRUCTURE AND INCLUDING A RESONANCE ELEMENT DISPOSED THEREIN WHICH IS SHORT-CIRCUITED TO THE BOX BY A PIN

(71) Applicant: KMW INC., Hwaseong, Gyeonggi-Do (KR)

(72) Inventors: Nam-Shin Park, Gyeonggi-Do (KR); Dae-Soo Jeong, Gyeonggi-Do (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 0 days.

(21) Appl. No.: 14/333,254

(22) Filed: Jul. 16, 2014

(65) Prior Publication Data

US 2014/0327499 A1 Nov. 6, 2014

Related U.S. Application Data

(63) Continuation of application No. PCT/KR2013/001518, filed on Feb. 26, 2013.

(30) Foreign Application Priority Data

Feb. 27, 2012 (KR) ..... 10-2012-0019722
Jan. 22, 2013 (KR) ..... 10-2013-0006945

(51) Int. Cl.
*H01P 1/205* (2006.01)
*H01P 1/207* (2006.01)
(Continued)

(52) U.S. Cl.
CPC ..... *H01P 1/2053* (2013.01); *H01P 1/205* (2013.01); *H01P 1/207* (2013.01); *H01P 1/208* (2013.01); *H01P 7/04* (2013.01)

(58) Field of Classification Search
CPC ..... H01P 1/205; H01P 1/2053; H01P 7/04
(Continued)

(56) References Cited

U.S. PATENT DOCUMENTS 5,329,687 A 7/1994 Scott et al.
5,550,519 A * 8/1996 Korpela ..... H01P 7/04 333/207
(Continued)

FOREIGN PATENT DOCUMENTS

CN 101916895 A 12/2010
CN 101976750 A 2/2011
(Continued)

OTHER PUBLICATIONS

Korean Office Action dated Mar. 14, 2017 in corresponding Korean Application No. 10-2013-0006945.

*Primary Examiner* — Benny Lee
(74) *Attorney, Agent, or Firm* — Mintz Levin Cohn Ferris Glovsky and Popeo, P.C.; Kongsik Kim; Colleen H. Witherell

(57) ABSTRACT

The present invention relates to a radio frequency filter having a cavity structure, comprising: a container which has a hollow inner portion and a cavity that is cut off from the outside, and a resonance element which is placed in the hollow inner portion of the container, wherein the container has a wrinkled structure for adjusting the intervals between a longitudinal front end surface of the resonance element and the inner surfaces of the container facing the longitudinal front end surface using external pressure. Thus, the invention can be further miniaturized and is lightweight, and the design of the invention enables frequency tuning without employing a coupling structure of a tuning screw and a fastening nut, thereby obtaining a convenient and simplified structure.

15 Claims, 26 Drawing Sheets

(51) Int. Cl.
*H01P 1/208* (2006.01)
*H01P 7/04* (2006.01)

(58) Field of Classification Search
USPC ..... 333/203, 224
See application file for complete search history.

(56) References Cited

U.S. PATENT DOCUMENTS 6,057,748 A * 5/2000 Hsing et al. ..... H01P 7/06 333/224
6,111,484 A 8/2000 Henningsson et al.
6,198,363 B1 3/2001 Vuoppola et al.
6,466,110 B1 * 10/2002 Wulff et al. ..... H01P 1/2053 333/206
7,327,210 B2 * 2/2008 Blair et al. ..... H01P 7/04 333/202
2001/0026202 A1 * 10/2001 Raty ..... H01P 7/04 333/222
2007/0194865 A1 8/2007 Weitzenberger et al.
2009/0237185 A1 9/2009 Raty
2010/0007446 A1 1/2010 Tachibana et al.
2011/0119902 A1 5/2011 Tachibana et al.

FOREIGN PATENT DOCUMENTS

CN 102354780 A 2/2012
CN 102623785 A 8/2012
EP 0 508 733 A2 10/1992
JP 59-139701 8/1984
JP 2002-501705 A 1/2002
JP 2005-184734 A 7/2005
JP 4191198 B2 12/2008
JP 2011-082882 A 4/2011
KR 10-2011-0013956 A 2/2011
WO WO-2008/026493 A1 3/2008

* cited by examiner

RADIO FREQUENCY FILTER HAVING A HOLLOW BOX WITH A WRINKLE STRUCTURE AND INCLUDING A RESONANCE ELEMENT DISPOSED THEREIN WHICH IS SHORT-CIRCUITED TO THE BOX BY A PIN

CROSS-REFERENCE TO RELATED APPLICATIONS

This application is a continuation of International Application No. PCT/KR2013/001518 filed on Feb. 26, 2013, which claims priority to Korean Application No. 10-2012-0019722 filed on Feb. 27, 2012 and Korean Application No. 10-2013-0006945 filed on Jan. 22, 2013, which applications are incorporated herein by reference.

TECHNICAL FIELD

The present invention relates to a radio signal processing apparatus used in a radio communication system, and more particularly to a radio frequency filter having a cavity structure.

BACKGROUND ART

A radio frequency filter having a cavity structure generally includes a plurality of accommodation spaces having a rectangular parallelepiped shape or the like, that is, a plurality of cavities through a metallic housing, and a dielectric resonance (DR) element or a resonance element having a metallic resonance rod is provided in the cavities to generate resonance of high frequency waves. In the radio frequency filter having the cavity structure, a cover for shielding an opened surface of the cavity structure is provided at an upper portion of the cavity structure, and a plurality of tuning screws and nuts for fixing the tuning screws are installed in the cover as a tuning structure for tuning filtering characteristics of the radio frequency filter. An example of a radio frequency filter having a cavity structure is disclosed in Korean Application Publication No. 10-2004-100084 (entitled "Radio Frequency Filter" and published on Dec. 2, 2004; inventors: Jonggyu Park, Sangsik Park, and Seungtaek Jeong) filed by the present applicant.

The radio frequency filter having a cavity structure is used for processing of a radio signals transmitted and received in a radio communication system, and it is applied to a base station or a relay in a mobile communication system.

Meanwhile, in the base station or the relay of the mobile communication system, the base station body apparatuses are installed on the ground, as compared with antenna apparatuses (generally, having a large volume and a heavy weight) installed at a column located at an elevation above the ground, and the antenna apparatus and the body apparatuses are currently connected through cables. However, this installation method causes a loss problem due to connections of cables between the antenna apparatus and the body apparatuses and an installation space problem of the body apparatus. Accordingly, as equipment has gradually become lightweight and miniaturized recently, the body apparatuses (or at least some modules) are disposed in a column for installation of antenna apparatuses to be connected to the antenna apparatus or to be included in the antenna apparatus.

Thus, when a radio frequency filter is applied to a base station or a relay of a mobile communication system, being small-scale and lightweight are more important considerations.

However, because a radio frequency filter having a cavity structure includes a resonance element in a housing and basically should have a coupling structure between a cover and a housing, there is a limit as to how small-scale and lightweight the radio frequency filter can be. Further, the coupling structure for a plurality of tuning screws and fixing nuts acts as an important restriction in how lightweight and small-scale of a radio frequency filter is.

SUMMARY OF THE INVENTION

Therefore, the present invention has been made in view of the above-mentioned problems, and an aspect of the present invention is a radio frequency filter having a cavity structure that is both small-scale and lightweight.

The present invention also provides a radio frequency filter having a cavity structure which can be easily manufactured and has a simplified structure.

The present invention also provides a radio frequency filter having a cavity structure by which frequency tuning can be allowed without employing a coupling structure for tuning screws and fixing nuts.

In accordance with an aspect of the present invention, there is provided a radio frequency filter including: a box having a hollow interior and having a cavity blocked from the outside; and a resonance element located in the interior hollow of the box, wherein the box has a wrinkle structure for adjusting the spacing between a lengthwise tip end surface of the resonance element and an inner surface of the box facing the tip end surface of the resonance element.

The box includes a first case in which the resonance element is located and a second case covering the first case, and the first and second cases are formed through pressing by using one mold each.

According to the present invention, a radio frequency filter having a cavity structure can be both small-scale and lightweight, can allow frequency tuning without employing a coupling structure for tuning screws and fixing nuts, and can have a simplified structure.

Accordingly, costs of the radio frequency filter can be reduced due to a simple manufacturing process thereof, and the radio frequency filter can be easily installed in a station such as a base station due to the radio frequency filter being small-scale and lightweight.

DETAILED DESCRIPTION OF THE INVENTION

Hereinafter, exemplary embodiments of the present invention will be described in detail with reference to the accompanying drawings.

Figure 1:
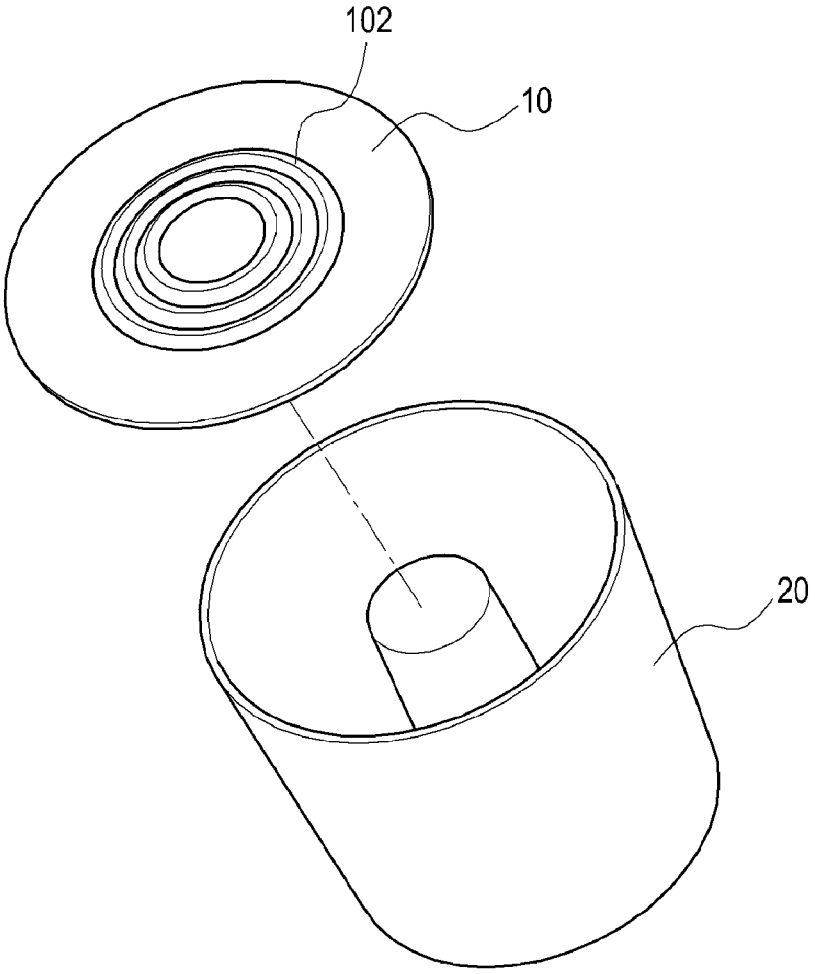
FIG. 1 is an exploded perspective view of a radio frequency filter having a cavity structure according to a first embodiment of the present invention.
Figure 2:
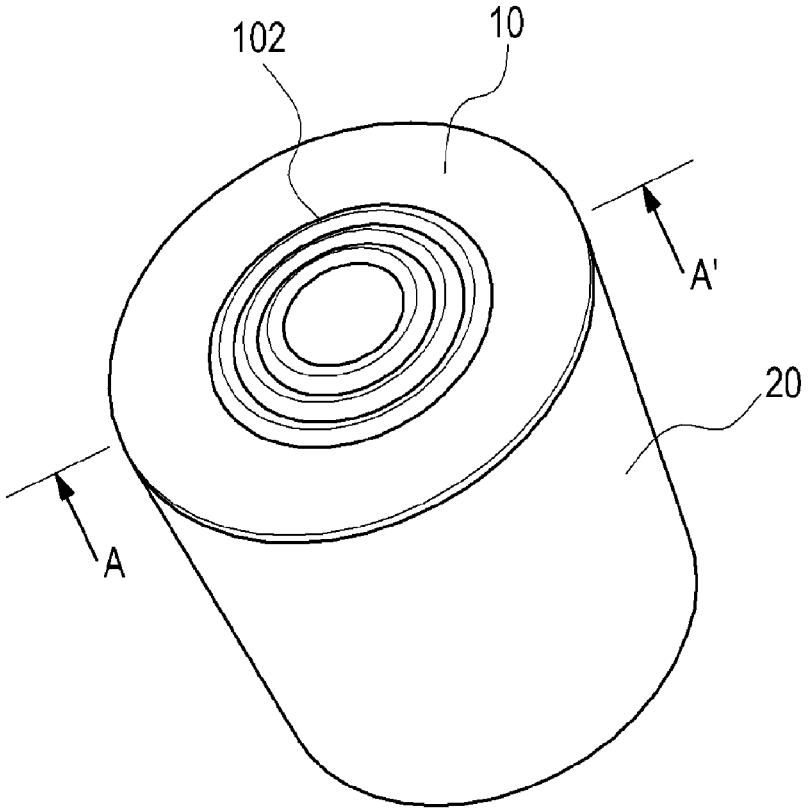
FIG. 2 is a perspective view showing a coupled state of FIG. 1.
Figure 3:
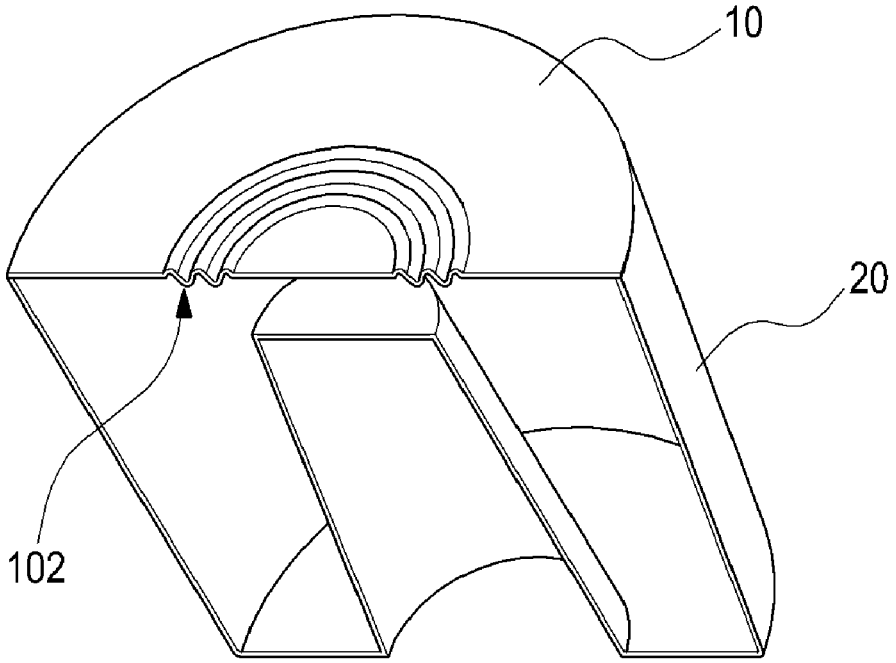
FIG. 3 is a cutaway perspective view taken along line A-A' of FIG. 2.
Figure 4:
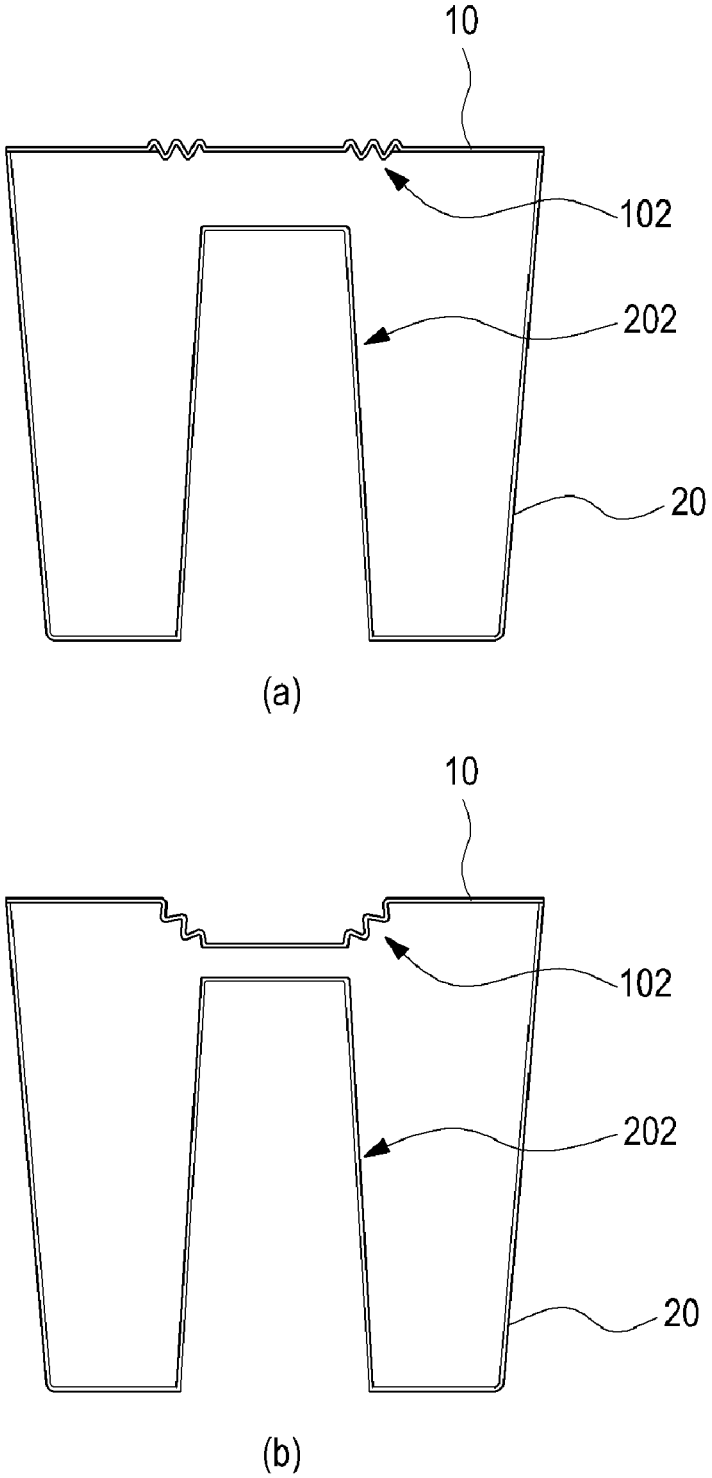
FIGS. 4A and 4B is are cutaway sectional views taken along line A-A' of FIG. 2.

FIG. 1 is an exploded perspective view of a radio frequency filter having a cavity structure according to a first embodiment of the present invention. FIG. 2 is a perspective view showing a coupled state of FIG. 1. FIG. 3 is a cutaway perspective view taken along line A-A' of FIG. 2. FIGS. 4A and 4B are cutaway sectional views taken along line A-A' of FIG. 2. Referring to FIGS. 1 to 4A and 4B, in a fashion similar to the related art, the radio frequency filter having a cavity structure according to the first embodiment of the present invention has a box of which an interior is hollow and having a cavity blocked from the outside, and a resonance element is provided in the hollow of the interior of the box. The box may include a first case, in which the resonance element is located, and a second case covering the first case. That is, an upper case 10 of the box corresponding to an upper side of the box with respect to a preset border surface (that is, a joint surface) of the entire case forming the cavity is the second case, and a lower case 20 corresponding to a lower side of the box with respect to the border surface of the entire case is the second case. The upper and lower cases 10 and 20 are jointed to each other on the border surface through soldering or welding.

In the example of FIGS. 1 to 4A and 4B, it is shown that the upper case 10 is plate-shaped to form an upper surface of the box when the entire filter structure is considered and functions as a cover, and the lower case 20 forms a lower surface and a side surface in the entire filter structure. Although FIGS. 1 to 4A and 4B show that the planar structure of the cavity is circular as a whole and the planar structures of the upper and lower cases 10 and 20 are circular accordingly, it is apparent that the planar structures of the upper and lower cases 10 and 20 may be formed in various forms such as a tetragonal shape.

The lower case 20 protrudes upwards toward the interior of the cavity at the center of the lower surface thereof such that an interior of the protrusion is empty and the pocket-shaped protrusion 202 (e.g., FIGS. 4A and 4B) of which an entrance faces the outside of the entire case is integrally formed with the remaining parts seamlessly—that is, with no separated joint surface. The protrusion 202 functions as a resonance element in the radio frequency filter. The lower case 20 having the protrusion 202 may be formed, for example, through pressing by using a plate-shaped mold formed of aluminum or magnesium (including an alloy thereof), and in particular, may be formed by using a deep drawing press to form the protrusion 202 having a relatively large depth. Of course, the size of the protrusion 202 is properly designed in consideration of a frequency such that the protrusion 202 may act as a resonance element. A through-hole (not shown) is further formed at a predetermined portion of the lower case 20 in consideration of the location of the protrusion 202 to connect an input/output terminal to the lower case 20.

Like the lower case 20, the upper case 10 may be formed by pressing by using a plate-shaped mold formed of aluminum or magnesium (including an alloy thereof). During the pressing, a wrinkle structure 102 for adjusting a spacing between a lengthwise tip end surface of the protrusion 202 and an inner surface of the box facing the tip end surface of the protrusion 202 (that is, an inner surface of the upper case) with an external pressure is formed at a portion of the upper case 10 corresponding to the protrusion 202 acting as the resonance element of the lower case 20. The wrinkle structure 102 is formed such that one or more curved surfaces protruding upwards and downwards are formed along a closed loop (for example, along a circle). As clearly shown in FIGS. 4A AND 4B, the wrinkle structure 102 is formed such that a cutaway surface of the upper case 10 is zigzagged.

The wrinkle structure 102 is adapted to replace a coupling structure of a tuning screw and a fixing nut according to the related art, and in the embodiment of the present invention, the wrinkle structure 102 is pressed from the upper side and the wrinkled portion includes a distance between the wrinkle structure band and an upper end of the protrusion 202 of the lower case 20 that may be narrowed until the filtering characteristics are optimized or the reference value is satisfied while the filtering characteristics are monitored during tuning of the frequency. FIG. 4A exemplifies the wrinkle structure 102 in the initial manufacturing process, and FIG. 4B exemplifies the wrinkle structure 102 during a frequency tuning operation.

In this way, in the embodiment of the present invention, the frequency tuning structure may be formed by using the wrinkle structure 102, and the wrinkle structure 102 is set to a material, a thickness, and a size such that it is not restored to an original state after being deformed according to the frequency tuning operation. The thickness of the wrinkle structure 102 may be set to be thinner than the thickness of the upper case 10.

In the radio frequency filter having a cavity structure according to the first embodiment of the present invention which is shown in FIGS. 1 to 4A and 4B, because the upper case 10 having the wrinkle structure 102, that is, a frequency tuning structure may be formed through a single pressing process and the lower case 20 having the protrusion 202 acting as a resonance element may be formed through a single pressing process, the radio frequency filter has a structure simpler than a structure employing a coupling structure of the tuning screw and the fixing nut according to the related art and can be manufactured promptly at low costs, and can be made smaller and lighter. In this case, because a tuning screw is not provided and a separate resonance element is not attached as compared with the related art, Passive Intermodulation Distortion (PIMD) characteristics due to the discontinuity of an inner surface forming the cavity can be improved.

In particular, the radio frequency filter structure according to the embodiment of the present invention may be used in a small structure with a high output as compared with the tuning screw according to the related art. When the tuning screw is used, a spacing between the tuning screw and the resonance element should be maintained at 5 mm or longer, for example, if it is used for a high output of 50 W. This is because a capacitance is concentrated at an edge portion of the tuning screw, and thus a spark may occur as the spacing between the tuning screw and the resonance element becomes smaller. In contrast, because the present invention does not include such a tuning screw, spacing between an upper end of the resonance element and the upper case can be narrowed, and the radio frequency filter can be operated more stably at a high output as compared with the related art.

Figure 5:
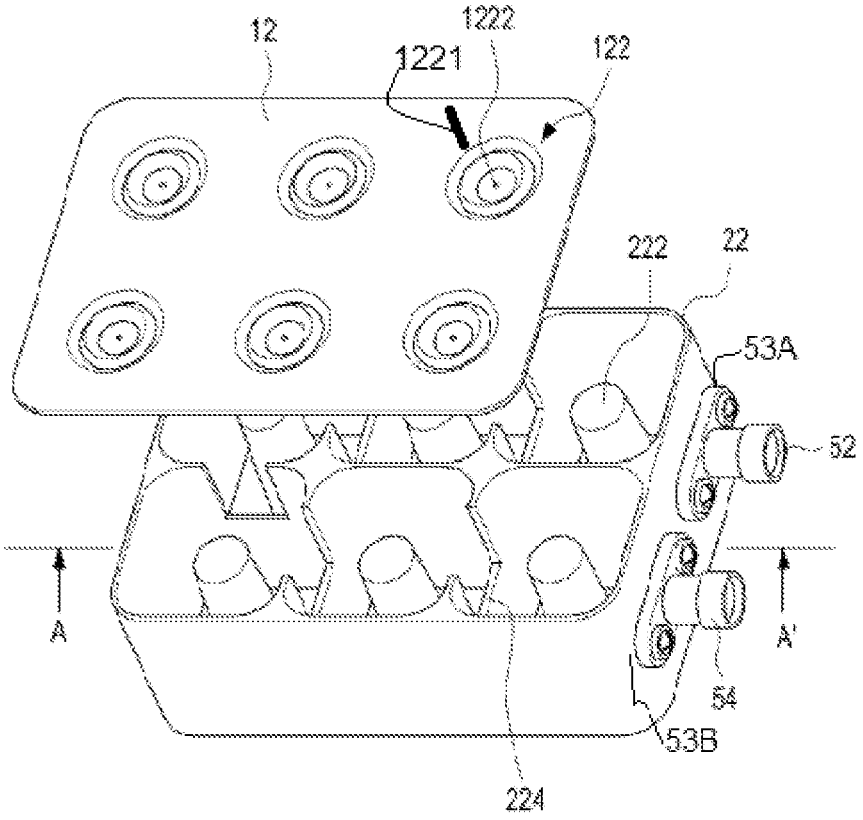
FIG. 5 is an exploded perspective view of a radio frequency filter having a cavity structure according to a second embodiment of the present invention.
Figure 6:
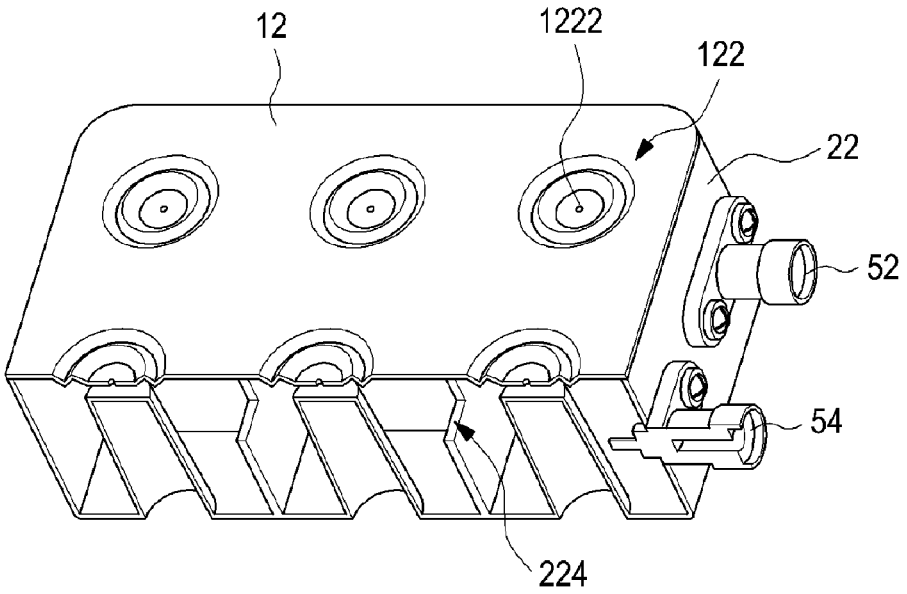
FIG. 6 is a cutaway perspective view taken along line A-A' of FIG. 5.

FIG. 5 is an exploded perspective view of a radio frequency filter having a cavity structure, according to a second embodiment of the present invention. FIG. 6 is a cutaway perspective view taken along line A-A' of FIG. 5. The structure according to the second embodiment of the present invention shows an example in which a plurality of cavities, for example, six cavity structures are connected in multiple stages. The structure shown in FIGS. 5 and 6 may be regarded as a structure in which three structures according to the first embodiment of the present invention shown in FIGS. 1 to 4A and 4B are located in each of two rows to be sequentially connected to each other.

Referring to FIGS. 5 and 6, in the structure according to the second embodiment of the present invention, a plurality of pocket-shaped protrusions 222 (FIG. 5) which protrude upwards toward a plurality of cavities at the centers thereof corresponding to the cavities have an empty interior, and having an entrance facing the outside of the entire case are formed in the lower case 22 without a seam with the remaining parts to act as resonance elements. Of course, the lower case 22 having the plurality of protrusions 222 is formed through a single pressing process by using a plate-shaped mold. Then, in the lower case 22, in order that the cavity structures have a sequential coupling structure, a coupling window 224 which is a connection passage structure is formed between the cavity structures having a sequential connection structure. Referring to FIGS. 5 and 6, the coupling window 224 may be formed such that a portion of the coupling window 224 is removed to a preset size at a portion corresponding to the partitions between the cavities.

A plurality of wrinkle structures 122 in which one or more curved surface protruding upwards and downwards is formed along a closed loop (for example, along a circle) at portions corresponding to the plurality of protrusions 222 of the lower case 22 are formed in the upper case 12 to be used for frequency tuning. Of course, the upper case 12 having the plurality of wrinkle structures 122 are formed through a single pressing process.

Conductive pin introducing holes 1222 of a fine size are formed at locations of the upper case 12 corresponding to the plurality of protrusions 222 of the lower case 22, and the conductive pin introducing holes 1222 are used to introduce conductive pins for short-circuiting the upper case 12 and the protrusions 222 of the lower case 22 during a frequency tuning operation. In more detail, the frequency tuning operation may be sequentially individually performed for the resonance elements (that is, protrusions) of the cavity structures according to the frequency tuning method, and in this case, it is necessary to electrically short-circuit the resonance elements in the remaining cavity structures other than the cavity structure on which a tuning operation is currently performed. Accordingly, the resonance element (protrusion) of the cavity structure can be short-circuited by introducing the conductive pins 1221 into the plurality of conductive pin introducing holes 1222.

Meanwhile, in FIGS. 5 and 6, an input terminal 52 and an output terminal 54 of the radio frequency filter are attached through the holes 53A and 53B of the lower case to be connected to the cavity structures of an input end and an output end.

Figure 7:
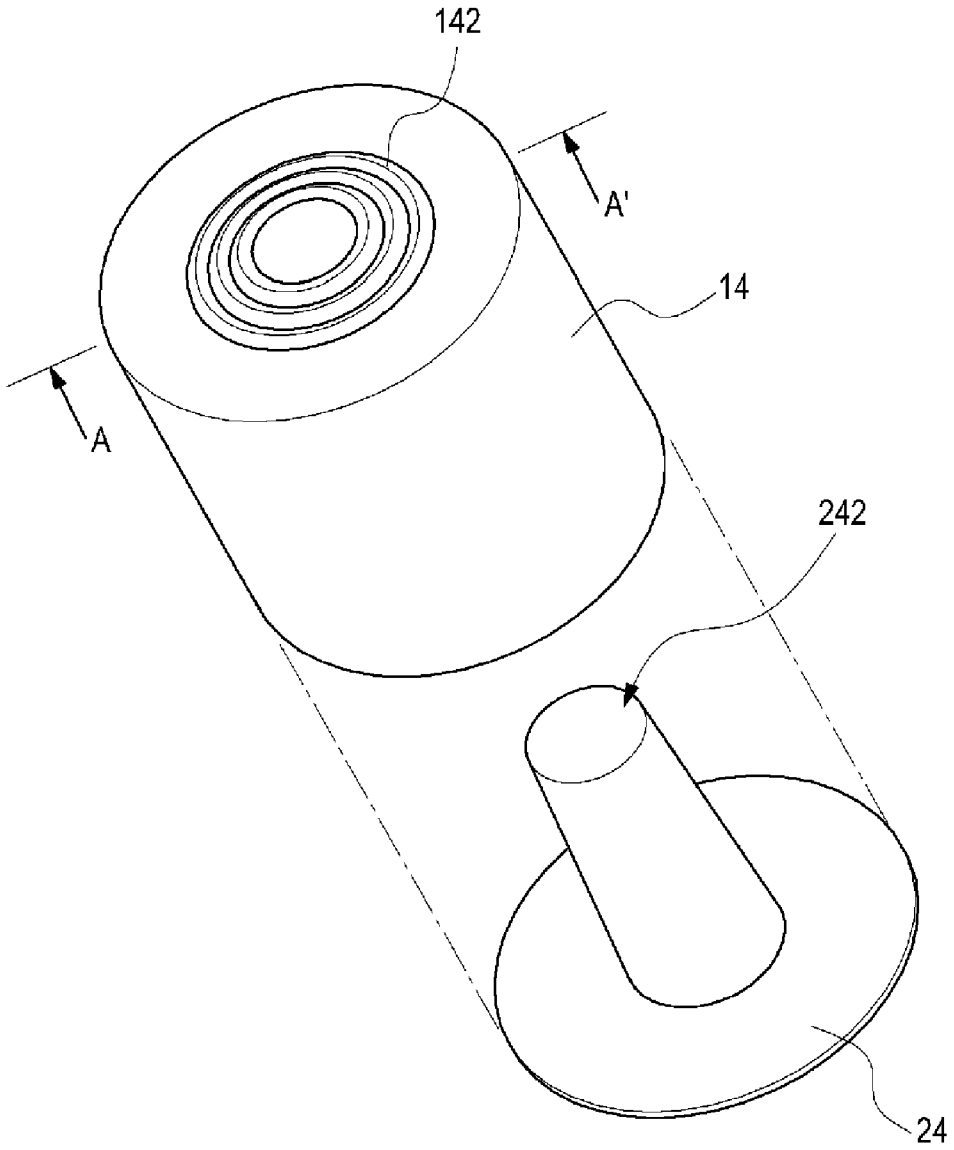
FIG. 7 is an exploded perspective view of a radio frequency filter having a cavity structure according to a third embodiment of the present invention.
Figure 8:
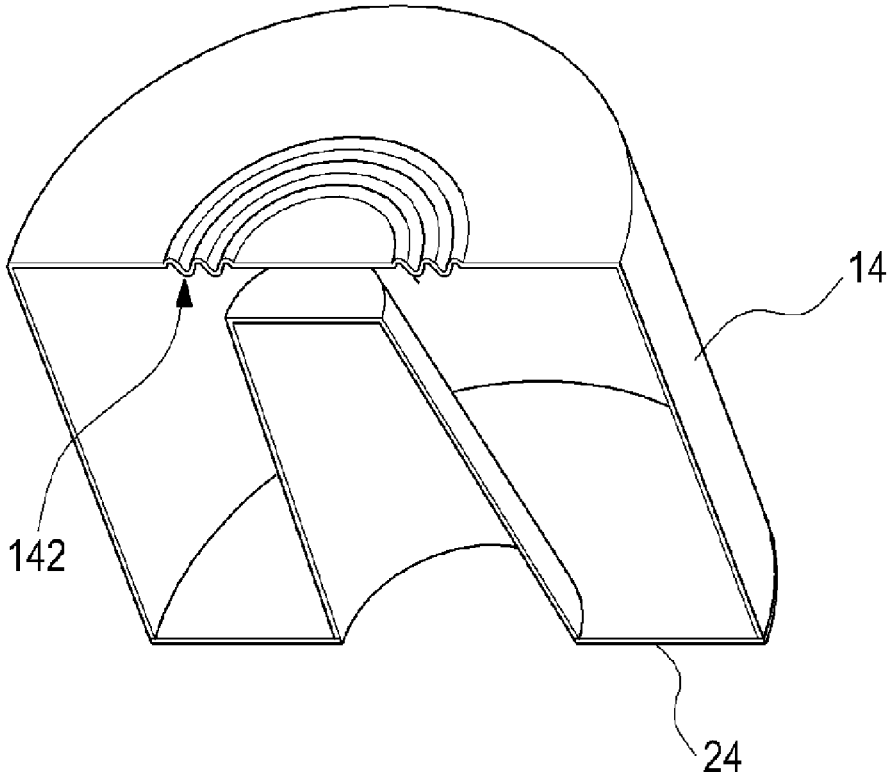
FIG. 8 is a cutaway perspective view taken along line A-A' of FIG. 7.

FIG. 7 is an exploded perspective view of a radio frequency filter having a cavity structure according to a third embodiment of the present invention. FIG. 8 is a cutaway perspective view taken along line A-A' of FIG. 7. Referring to FIGS. 7 and 8, although the entire external appearance of the structure according to the third embodiment of the present invention is similar to the structure of the first embodiment shown in FIGS. 1 to 4A and 4B, the upper case 14 includes an upper surface and a side surface to have a pocket shape—taking into consideration the entire filter structure and the lower case 24 form only a surface corresponding to the lower surface of the entire filter structure. Of course, even in the structure according to the fourth embodiment of the present invention, a protrusion 242 (FIG. 7) is formed in the lower case 24 and a wrinkle structure 142 is formed in the upper case 14.

In the structure of the third embodiment shown in FIGS. 7 and 8, a border surface (joint surface) between the upper case 14 and the lower case 24 is set differently as compared with the structure of the first embodiment. The border surface may be properly set at any location on a side surface of the entire structure of the radio frequency filter, and accordingly, the upper case 14 and the lower case 24 may be formed.

Figure 9:
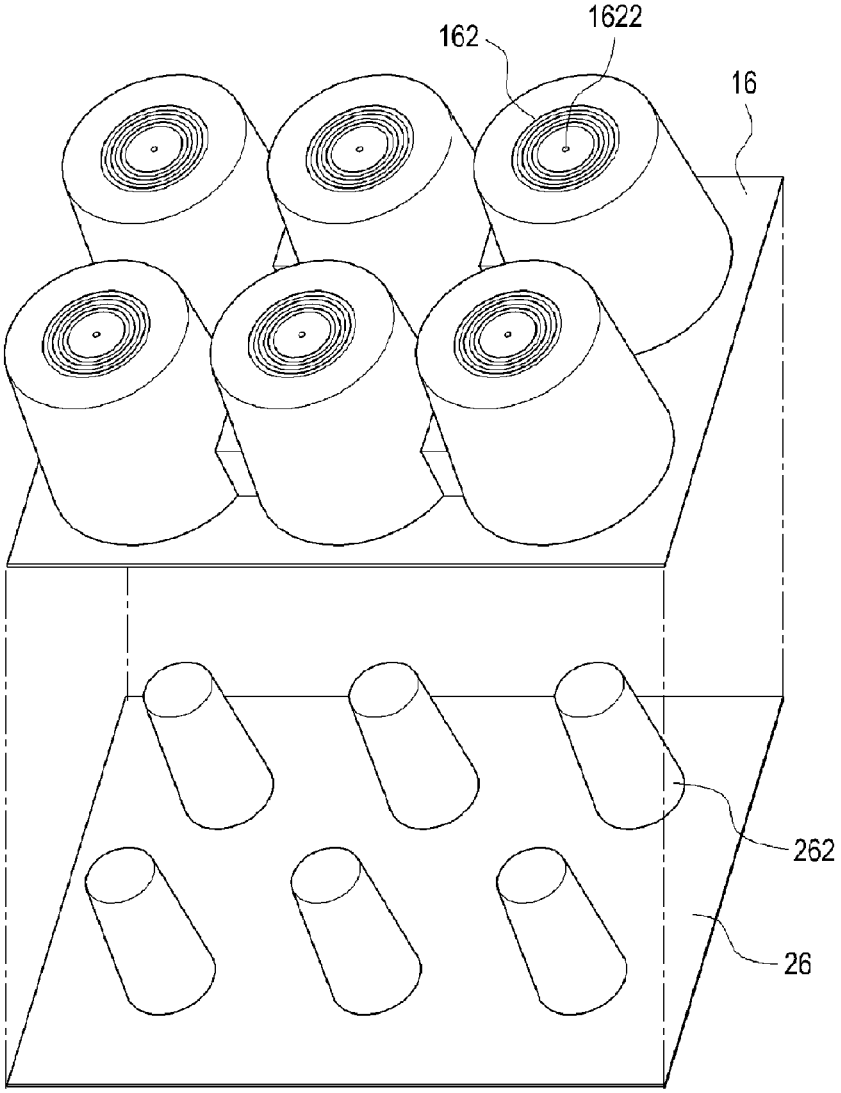
FIG. 9 is an exploded perspective view of a radio frequency filter having a cavity structure according to a fourth embodiment of the present invention.
Figure 10:
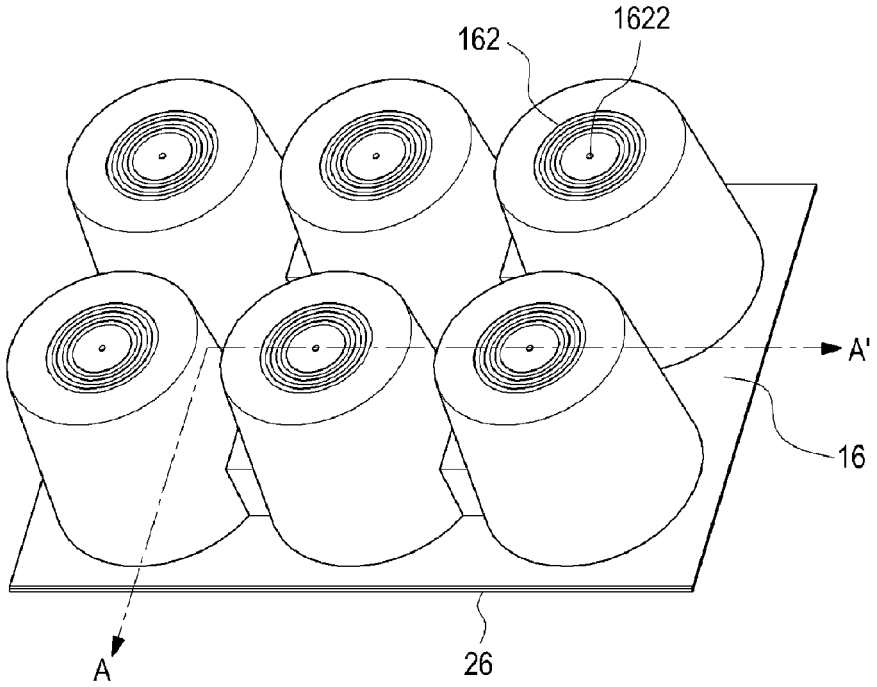
FIG. 10 is a perspective view showing a coupled state of FIG. 9.
Figure 11:
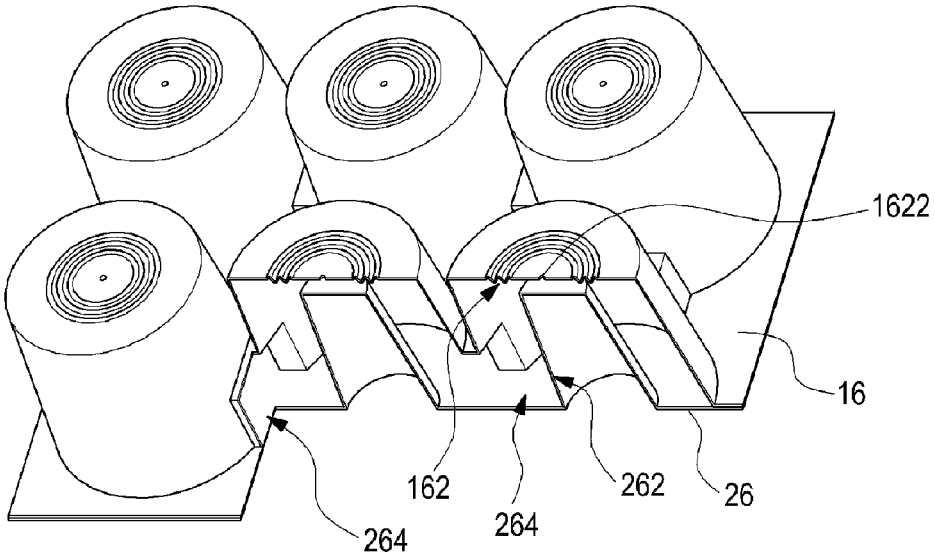
FIG. 11 is a cutaway perspective view taken along line A-A' of FIG. 10.

FIG. 9 is an exploded perspective view of a radio frequency filter having a cavity structure according to a fourth embodiment of the present invention. FIG. 10 is a perspective view showing a coupled state of FIG. 9. FIG. 11 is a cutaway perspective view taken along line A-A' of FIG. 10. The structure, according to the fourth embodiment of the present invention, shows an example in which a plurality of cavities, for example, six cavity structures are connected in multiple stages. The structure shown in FIGS. 9 and 11 may be regarded as a structure in which three structures according to the third embodiment of the present invention shown in FIGS. 7 to 9 are located in two rows to be sequentially connected to each other.

Referring to FIGS. 9 to 11, in the structure according to the fourth embodiment of the present invention, a plurality of protrusions 262 (e.g., FIGS. 9, 11) corresponding to a plurality of cavity structures are formed in the substantially plate-shaped lower case 26, and wrinkle structures 162 are formed at portions of the upper case 16 corresponding to a plurality of protrusions 262 of the lower case 26 in the upper case 16 in which a plurality of pockets corresponding to the cavity structures are connected. Then, in the upper case 16, in order that the cavity structures have a sequential coupling structure, a coupling window 264 (FIG. 11) which is a connection passage structure is formed between the cavity structures having a sequential connection structure. Conductive pin introducing holes 1622 are formed at locations of the upper case 16 corresponding to the plurality of protrusions 262 of the lower case 26.

As described above, a radio frequency filter having a cavity structure according to a plurality of embodiments of the present invention may be provided, and various embodiments or modifications may be additionally made.

For example, although it is shown that the wrinkle structure is formed in the upper case, the wrinkle structure may be omitted when the filter can be manufactured with almost no processing tolerance through a precise process or when the filter does not require precise frequency tuning.

As in the embodiment shown in FIG. 5, although it has been described that conductive pin introducing holes for short-circuiting the upper case and the protrusions of the lower case are formed at locations of the upper case corresponding to the protrusions of the lower case for a frequency tuning operation in the filter structure having a plurality of cavities, a structure in which holes having this purpose are formed at upper ends of the protrusions of the lower case may be further provided.

As in the embodiment shown in FIG. 5, in the filter structure having a plurality of cavities, a wrinkle structure similar to the tuning structure for frequency tuning may be further formed at locations of the upper case corresponding to the coupling window of the lower case to employ a structure for coupling tuning.

Although it has been described that both the upper case and the lower case are formed of aluminum or magnesium, they may be formed of various materials, and in particular, the upper case and the lower case may be formed of the same material or may be formed of different materials.

As shown in FIG. 5, in particular, when the upper case is formed of a thin plate, the upper case may be formed of plastic. Of course, the upper case or the lower case may be made by plastic in a form other than a thin plate.

Figure 12:
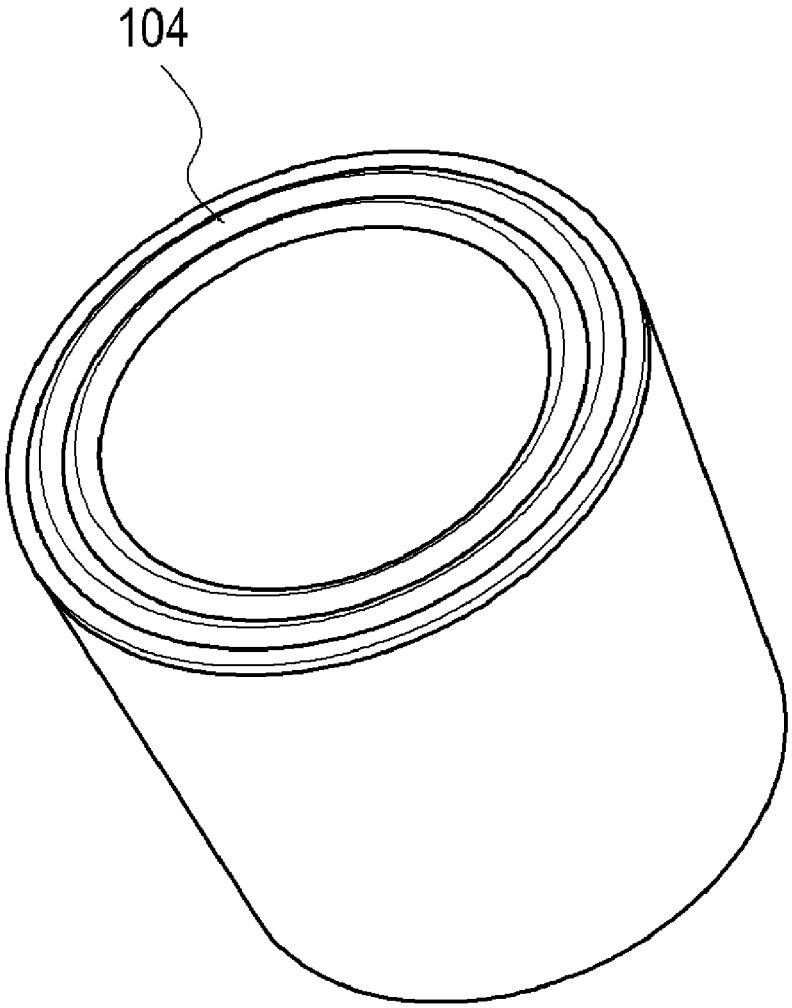
FIGS. 12 to 15 are views showing modifications of the present invention.

Although it has been described that the wrinkle structure formed in the upper case is formed at a location corresponding to the protrusions of the lower case, for example, is formed at a central planar portion, the wrinkle structure 104 may be formed at a peripheral planar portion as shown in FIG. 12. That is, it can be seen that the size of the circular locus appearing due to the wrinkle structure 104 shown in FIG. 12 is larger than that of the other embodiments.

Figure 13:
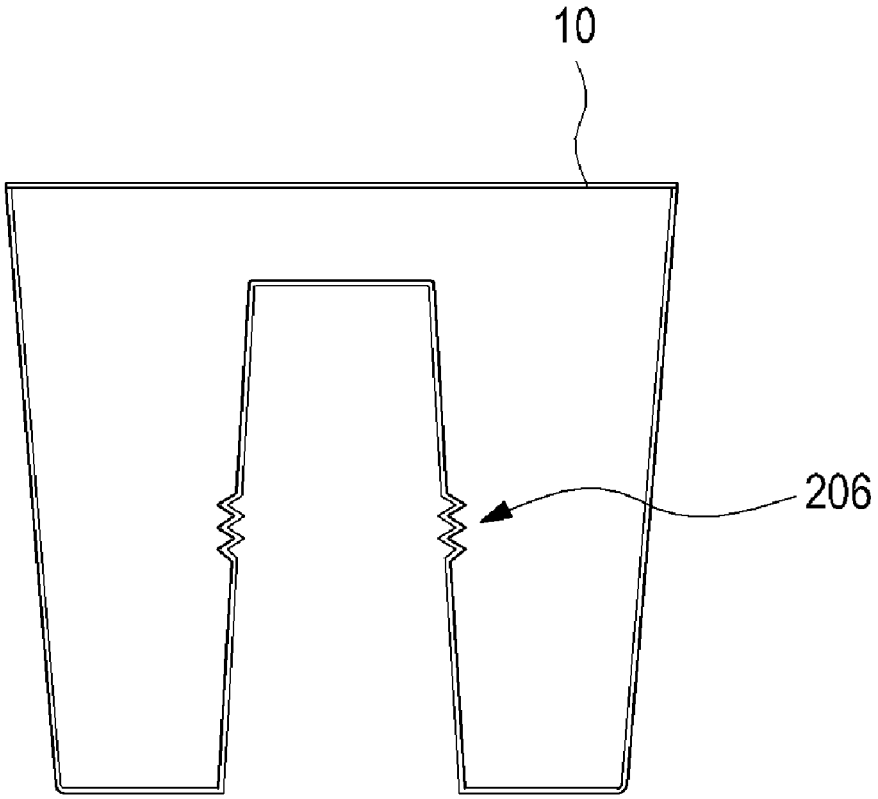
Figure 14:
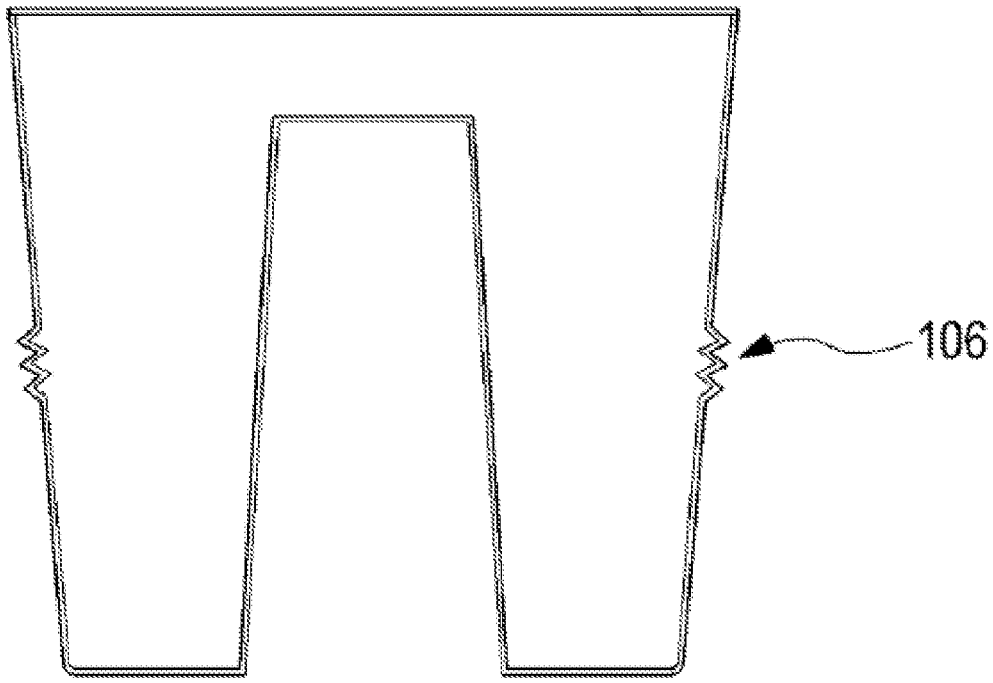

Although it has been described that the wrinkle structure 206 is formed in the upper case 10, it may be formed on a side surface of the protrusion of the lower case acting as a resonance element as shown in FIG. 13. As shown in FIG. 14, a structure providing a wrinkle 106 may be employed at a box surface of the lower case facing a widthwise tip end of the protrusion acting as a resonance element that is, at a portion corresponding to a side surface of the entire filter structure.

Although it has been described that both the upper case and the lower case of the present invention are formed through a pressing operation, the lower case may be realized without a wrinkle structure according to the related art and only the upper case having a wrinkle structure according to the present invention may be advantageous to the small-scale and lightweight design of the product.

Figure 15:
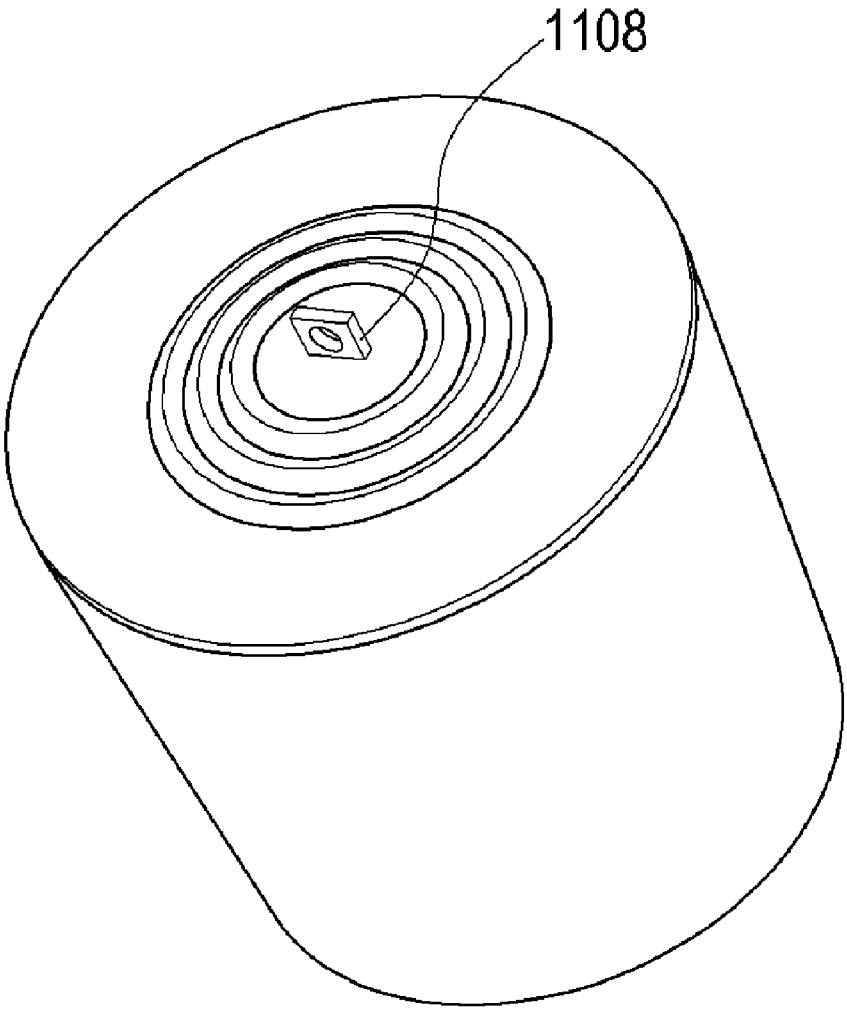

Referring to FIG. 15, in another embodiment of the present invention, a protruding member 1108 having a proper shape may be further formed at a location of the upper case having a wrinkle structure. The protruding member 1108 may be formed at the same time when the upper case is pressed, or may be separately manufactured and attached later through laser welding. The protruding member 1108 is to be pulled on directly or by connecting a separate ring to a catching structure such as a hole, which may be formed in the protruding member 1108, and the wrinkle structure pressed and spread out (e.g., expanded) downwards may return to an original stage (to a degree) during frequency tuning to be more useful or be retuned during the frequency tuning operation.

Figure 16:
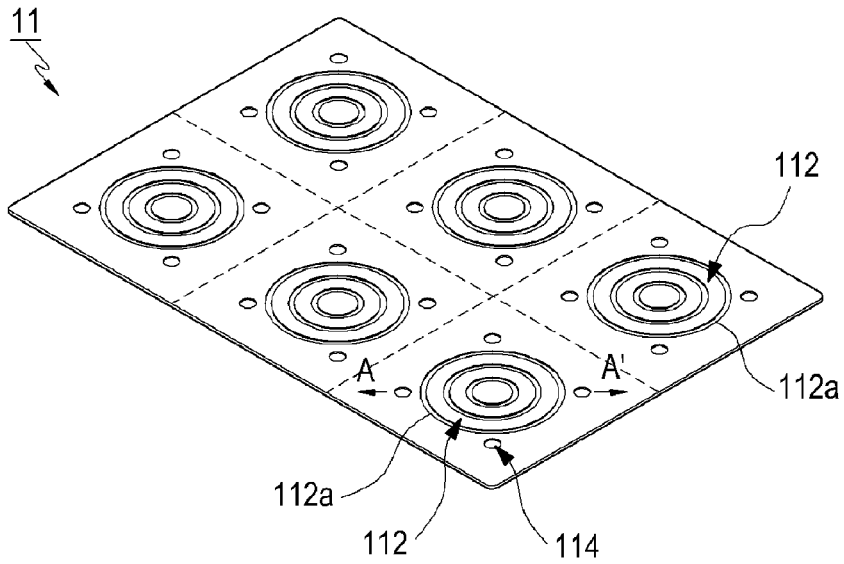
FIG. 16 is a perspective view of an upper case of a radio frequency filter having a cavity structure according to a fifth embodiment of the present invention.
Figure 17:
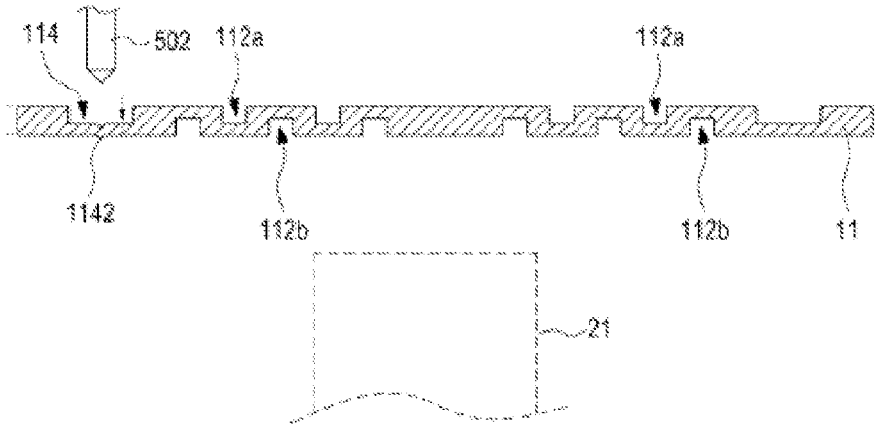
FIG. 17 is a cutaway sectional view taken along line A-A' of FIG. 16.

FIG. 16 is a perspective view of the upper case (that is, the second case) acting as a cover of the radio frequency filter having a cavity structure according to the fifth embodiment of the present invention. FIG. 17 is a cutaway sectional view taken along line A-A' of FIG. 16. In the fifth embodiment shown in FIGS. 16 and 17, the lower case is omitted for convenience of description. As in the second embodiment shown in FIG. 5, in the fifth embodiment shown in FIGS. 16 and 17, a six-cavity structure, for example, a structure in which two groups of three cavities are sequentially connected in two rows is provided and the upper case 11 has a structure corresponding to the six-cavity structure. The lower case (not shown) may have a structure similar to the structure of the second embodiment shown in FIG. 5, and a structure in which a separately manufactured resonance element is installed may be provided as a general structure according to the related art. In this situation, the upper case 11 may be screw-coupled to the lower case, and a plurality of screw holes (not shown) for screw coupling may be formed at locations of the upper case 11.

Referring to FIGS. 16 and 17, as in the other embodiments of the present invention, where a plurality of wrinkle structures 112 (FIG. 16) in which one or more curved surfaces protruding upwards and downwards are formed along a closed loop (for example, along a circle) to be used for frequency tuning at portions of the upper case 11 acting as a cover in the radio frequency filter according to the fifth embodiment of the present invention, the portions of the upper case 11 corresponding to a plurality of resonance elements 21 (or protrusions) as shown in FIG. 17 are formed or installed in the lower case.

However, unlike the other embodiments in which the side surface shapes of the curved surfaces protruding upwards and downward have a triangular curved shape, the wrinkle structure 112 of the fifth embodiment of the present invention has a rectangular curved structure. As an example, in order to form a rectangular curved structure, a plurality of substantially circular recesses 112*a* and 112*b* are alternately formed on an upper surface and a lower surface of the upper case 11 so as not to meet each other.

As in the other embodiments, the upper case 11 may be manufactured through a single pressing process at the same time when the wrinkle structure 112 is formed. In addition, it may be more efficient to manufacture the wrinkle structure 112 by forming the recesses 112*a* and 112*b* (FIG. 17) through cutting after the plate-shaped upper case 11 is manufactured according to the size of the radio frequency filter.

Referring to FIGS. 16 and 17, in the fifth embodiment of the present invention, at least one depression 114 of upper case 11 recessed toward the interior hollow may be formed near the wrinkle structure 112 of the upper case 11.

The depression 114 is for auxiliary or additional frequency tuning, and a dot peen structure 1142 (FIG. 17) is formed in the depression 114 through stamping or pressing by a stamping pin 502 (FIG. 17) of external stamping equipment during an auxiliary frequency tuning operation. As a result, the dot peen structure 1142 performs an auxiliary frequency tuning operation by narrowing a distance between the lower surface of the depression 114 (FIG. 17) and the resonance element 21 (also, by changing the volume of the interior hollow).

Figure 18:
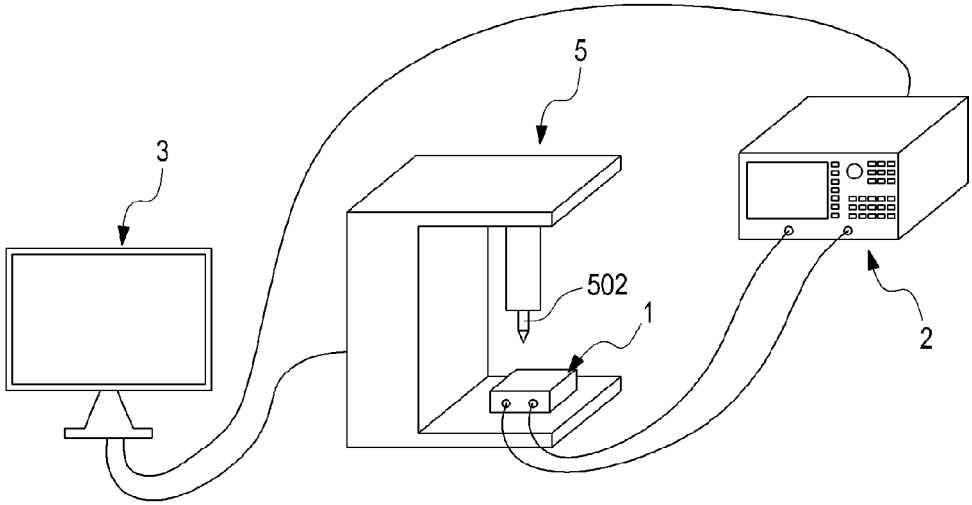
FIG. 18 is a diagram of a frequency tuning apparatus for the radio frequency filter according to the fifth embodiment of FIG. 16.

Referring to FIG. 18, in the entire configuration of the frequency tuning apparatus, the radio frequency filter 1 according to the fifth embodiment of the present invention which is an object for frequency tuning is positioned on a shelf of the stamping equipment 5, which includes a stamping pin 502. The stamping equipment 5 may include a general dot peen-marking machine. The operation characteristics of the radio frequency filter 1 is measured by measurement equipment 2, and accordingly, the measurement equipment 2 is connected to the radio frequency filter 1 to provide an input signal of a preset frequency to the radio frequency filter 1 and receive an output of the radio frequency filter 1. The operation characteristics of the radio frequency filter 1 measured by the measurement equipment 2 are provided to control equipment 3, which can be recognized by a PC. The control equipment 3 controls an operation of the stamping equipment 5 until the filtering characteristics are optimized or a reference value is satisfied (while monitoring operation characteristics of the radio frequency filter 1), and the stamping equipment 5 forms a predetermined number of dot peen structures 1142 having a predetermined shape on the recessed surface of a convexo-concave structure 114 of the radio frequency filter 1.

A plurality of dot peen structures 1142 may be formed in the depression 114. The thickness and width of the depression 114 as shown in FIG. 17 are properly set so as not to be deformed even by a stress during a frequency tuning operation during which the dot peen structure 1142 is formed. A dot peen structure 1142 representing a different variable amount may be formed even when an operation is performed by the same stamping equipment 5 according to the differences of the widths, thicknesses, or shapes of the depression 114. The detailed structure of the depression 114 may be properly designed according to the feature or condition required by the radio frequency filter 1.

Figure 19:
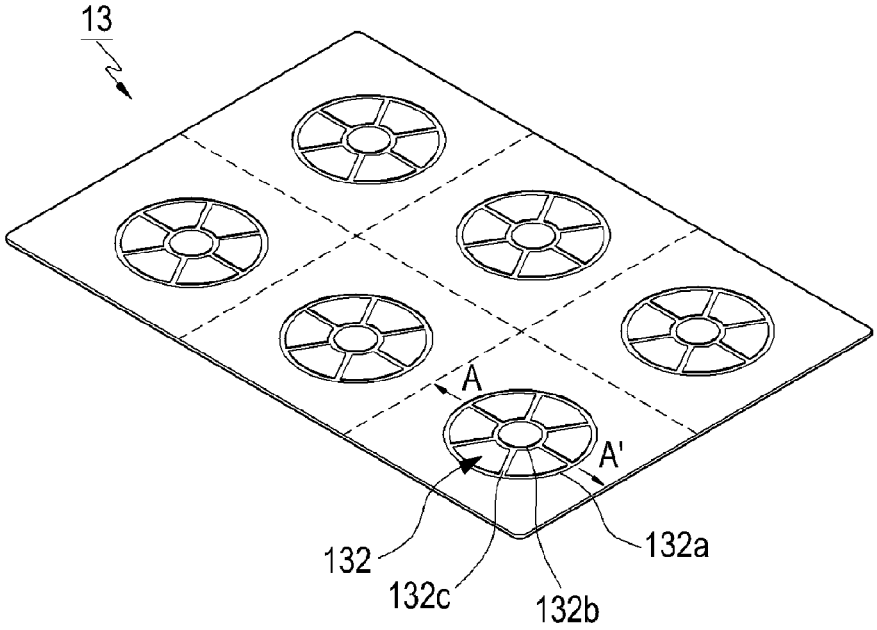
FIG. 19 is a perspective view of an upper case of a radio frequency filter having a cavity structure according to a sixth embodiment of the present invention.
Figure 20:
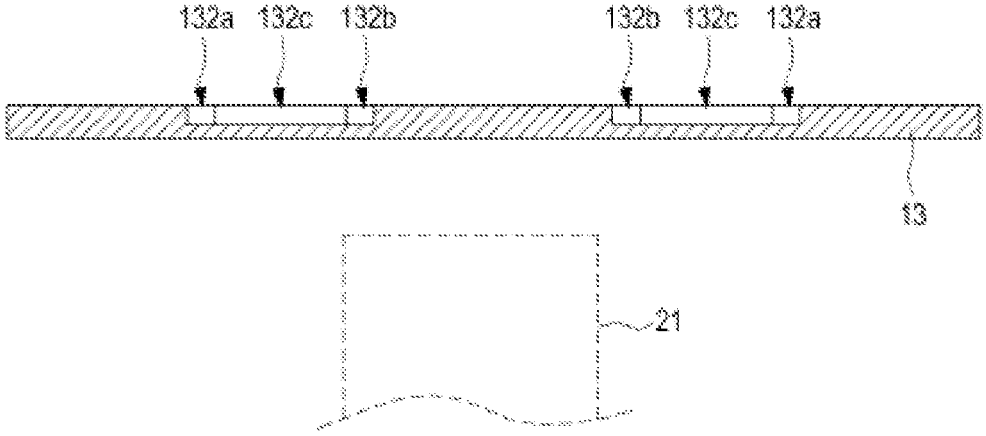
FIG. 20 is a cutaway sectional view taken along line A-A' of FIG. 19.

FIG. 19 is a perspective view of an upper case of a radio frequency filter having a cavity structure according to a sixth embodiment of the present invention. FIG. 20 is a cutaway sectional view taken along line A-A' of FIG. 19. In the sixth embodiment shown in FIGS. 19 and 20, the lower case is omitted for convenience of description. The lower case (not shown) may have a structure similar to the structure of the second embodiment shown in FIG. 5, and a structure in which a separately manufactured resonance element is installed may be provided as in a general structure according to the related art.

Referring to FIGS. 19 and 20, as in the other embodiments, a wrinkle structure 132 (FIG. 19) is formed at portions of the upper case 13 acting as a cover in the radio frequency filter according to the sixth embodiment of the present invention, the portions of the upper case 13 corresponding to a plurality of resonance elements 21 (FIG. 20) (or protrusions) are formed or installed in the lower case, and a plurality of recesses 132*a* and 132*b* are formed on an upper surface of the wrinkle structure 132 in a closed loop form (for example, a circle) while a lower surface of the plate-shaped upper case 13 is not deformed.

The structure shown in FIGS. 19 and 20 requires a rather stronger pressing pressure as compared with the other embodiments when the wrinkle structure 132 is pressed during a frequency tuning operation, and one or more additional connection recesses 132*c* connecting the plurality of circular recesses 132*a* and 132*b* may be further formed.

As in the other embodiments, the upper case 13 may be manufactured through a single pressing operation at the same time when the wrinkle structure 132 is formed, and it may be manufactured by forming the recesses 132*a*, 132*b*, and 132*c* through cutting after the upper case 13 is manufactured.

Figure 21:
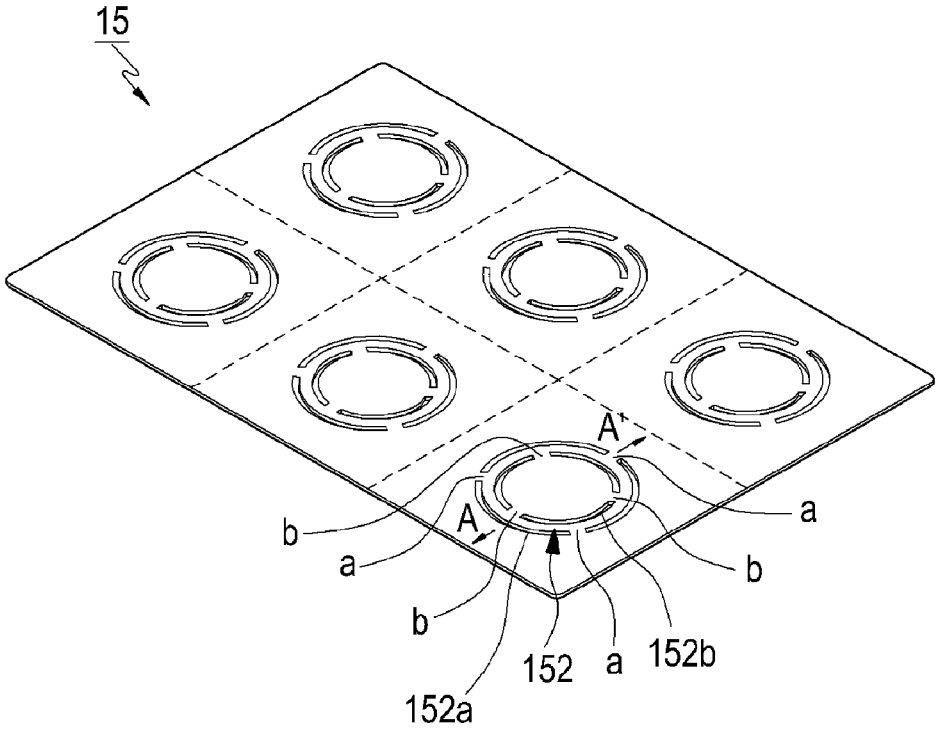
FIG. 21 is a perspective view of an upper case of a radio frequency filter having a cavity structure according to a seventh embodiment of the present invention.
Figure 22:
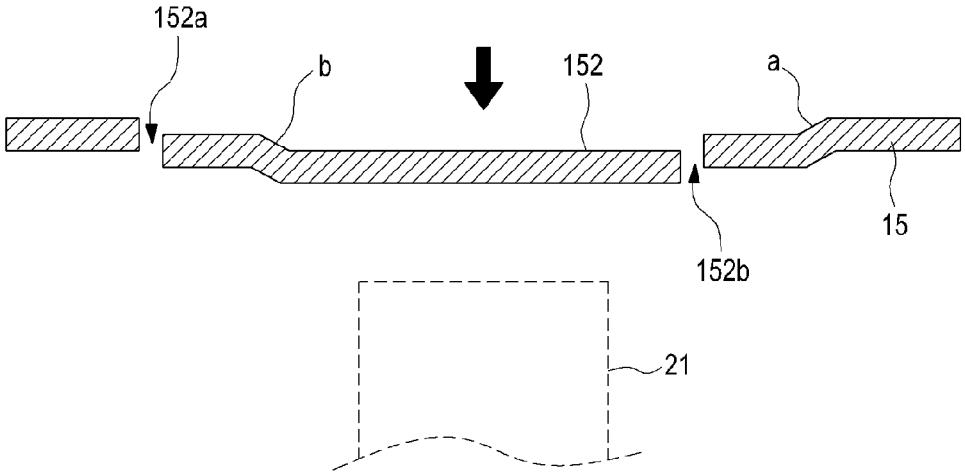
FIG. 22 is a cutaway sectional view taken along line A-A' of FIG. 21.

FIG. 21 is a perspective view of an upper case of a radio frequency filter having a cavity structure according to a seventh embodiment of the present invention. FIG. 22 is a cutaway sectional view taken along line A-A' when the pressed portion of FIG. 21 is pressed in an arrow direction. The lower case is not shown for convenience of description. Referring to FIGS. 21 and 22, in the radio frequency filter according to the seventh embodiment of the present invention, the wrinkle structure of the other embodiments is not provided in the upper case 15, but press portions 152 of a preset shape (for example, a circle) are formed at portions of the upper case corresponding to the plurality of resonance elements 21 (or protrusions) formed or installed in the lower case.

Almost all the contours of the press portions 152 are as shown in FIG. 22, formed by one or more slots 152*a* and 152*b* to form an entire shape. One or more connecting points a and b (having no slots) of the contours are connected to other portions of the upper case to support the press portions 152. That is, the press portions 512 are surrounded by the slots 152*a* and 152*b* and the connecting points a and b.

Referring to FIGS. 21 and 22, the press portions 152 are formed in a circular shape having a dual structure in which three arc-shaped slots, denoted by reference numeral 152*a*, form a circle while the connecting point a is interposed therebetween; and three arc-shaped slots, denoted by reference numeral 152*b*, form a circle while the connecting point b is interposed therebetween. In another embodiment of the present invention, it is apparent that the press portions do not have a dual circular shape but have one circular structure or a triple circular shape.

In this structure, as shown in FIG. 22, if the press portions 152 are pressed (as depicted by the downward arrow) during a frequency tuning operation, the press portions 152 are introduced into the resonance element 21 of the lower case by extending or bending the connecting points a and b, and a frequency tuning operation is performed by adjusting the distance between the press portions 152 and the resonance element 21.

Although a radio signal may be leaked through the slots when the slots are formed in the upper case of the radio frequency filter, it may be considered that a radio frequency filter is employed in an apparatus which is not sensitive to a leakage of a signal.

Figure 23:
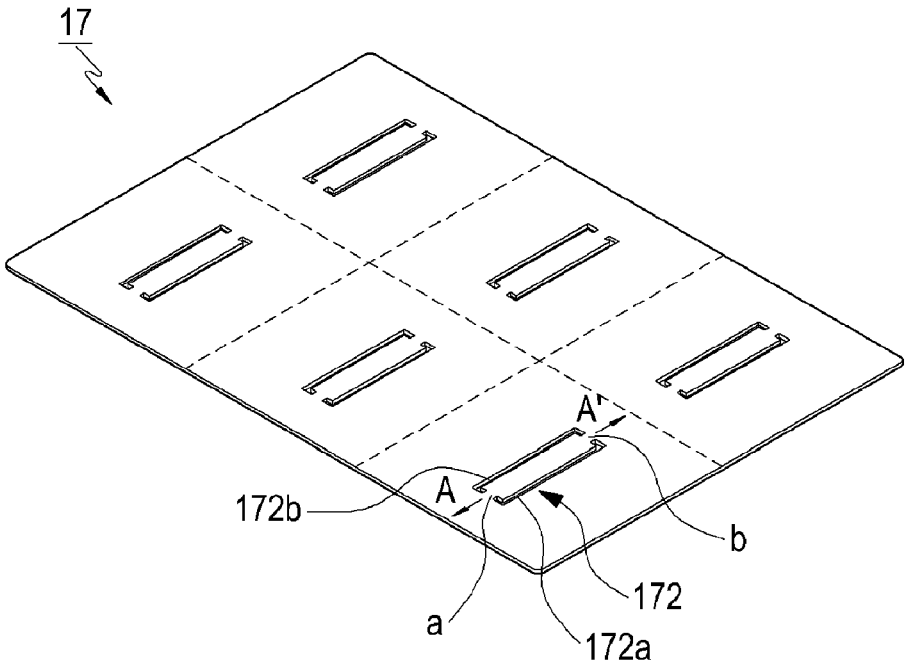
FIG. 23 is a perspective view of an upper case of a radio frequency filter having a cavity structure according to an eighth embodiment of the present invention.
Figure 24:
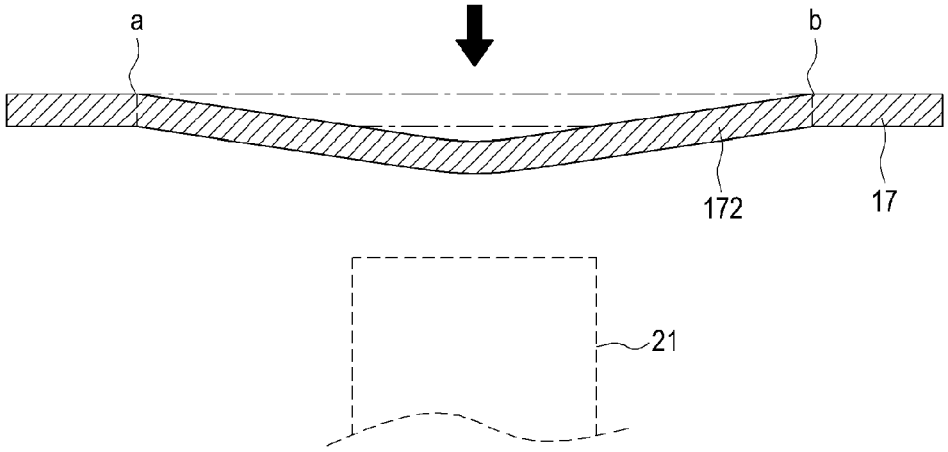
FIG. 24 is a cutaway sectional view taken along line A-A' of FIG. 23.

FIG. 23 is a perspective view of an upper case of a radio frequency filter having a cavity structure according to an eighth embodiment of the present invention. FIG. 24 is a cutaway sectional view taken along line A-A' when the press portion of FIG. 23 is pressed (as depicted by the downward arrow) in an arrow direction. The lower case is not shown for convenience of description. Referring to FIGS. 23 and 24, the radio frequency filter according to the eighth embodiment of the present invention includes a press portion 172 which is realized by a principle similar to the seventh embodiment disclosed in FIGS. 21 and 22, and the difference between the eighth embodiment and the seventh embodiment lies in the overall shape of the press portion 172.

In more detail, referring to FIGS. 23 and 24, as in the seventh embodiment, almost all the contour of the press portion 172 is formed by one or more slots 172*a* and 172*b* as shown in FIG. 22 to form an entire shape. One or more connecting points a and b of the contour are connected to other portions of the upper case 17 to support the press portions 172. The press portion 172 may have a substantially long bar shape, and the connecting points a and b may be formed at opposite ends of the bar shape.

As shown in FIG. 24, if the press portion 172 is pressed (as depicted by the downward arrow) during the frequency tuning operation in this structure, the connecting points a and b are extended and bent, and a central portion of the press portion 172 in the form of a bar is bent toward the resonance element 21 (FIG. 24) of the lower case for frequency tuning.

Figure 25:
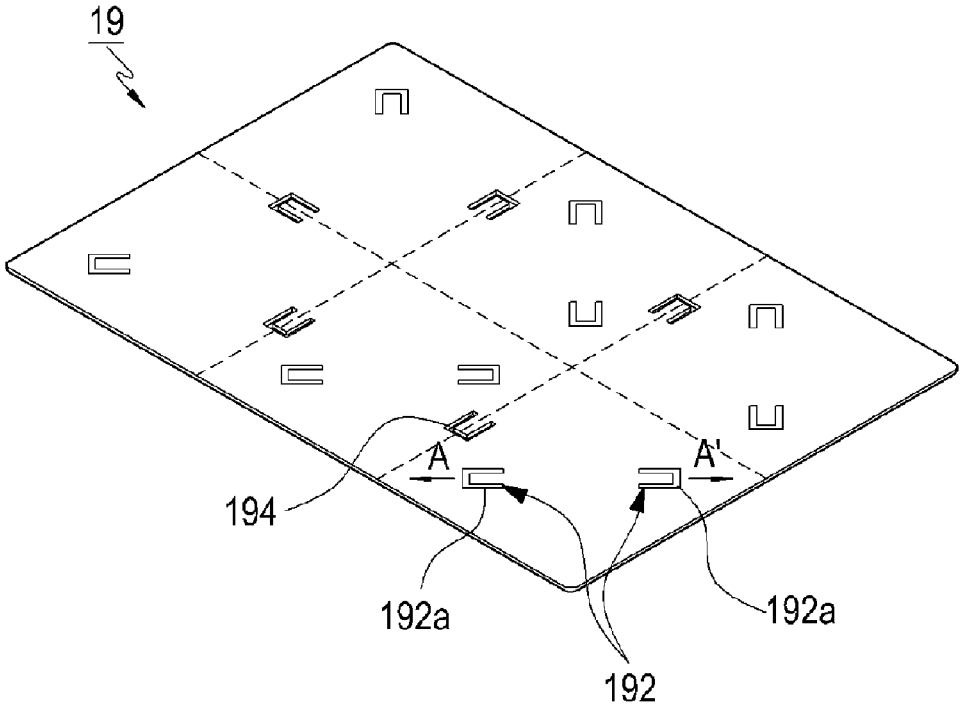
FIG. 25 is a perspective view of an upper case of a radio frequency filter having a cavity structure according to a ninth embodiment of the present invention.
Figure 26:
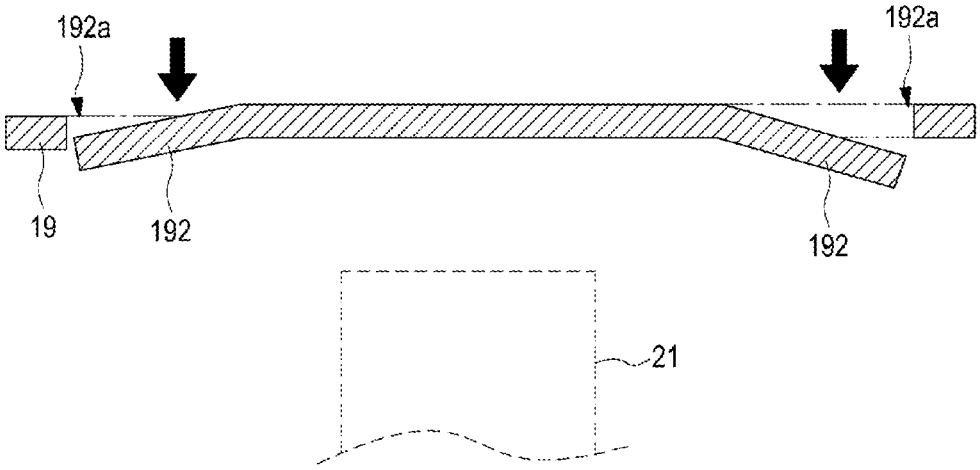
FIG. 26 is a cutaway sectional view taken along line A-A' of FIG. 25.

FIG. 25 is a perspective view of an upper case of a radio frequency filter having a cavity structure according to a ninth embodiment of the present invention. FIG. 26 is a cutaway sectional view taken along line A-A' when the pressed portion of FIG. 25 is pressed. Referring to FIGS. 25 and 26, the radio frequency filter according to the ninth embodiment of the present invention includes a press portion 192 which is realized by a principle similar to the seventh and eighth embodiments disclosed in FIGS. 21 and 24, and the difference between the ninth embodiment and the other embodiments lies in the overall shape of the press portion 192.

As in the seventh and eighth embodiments of the present invention, the contour of the press portion 192 is formed by one or two slots 192*a* to form a substantial U-shape. The press portion 192 is connected to another portion of the upper case 19 through the connecting point a of the contour where a slot 192*a* is not formed.

As shown in FIG. 26, if the press portion 192 is pressed as depicted by the downwards arrow during the frequency tuning operation in this structure, the connecting points a and b are extended and bent, and one end of the press portion 192 in the form of a U shape is pushed and lowered toward the resonance element 21 (FIG. 26) of the lower case for frequency tuning.

Although it is shown that one or two resonance elements 21 (FIG. 26) are formed at a particular location rather deviating from the center of the upper case facing the upper end of the resonance element 21, the locations and number of the press portions 192 may be properly set according to the characteristics of the filter in FIGS. 25 and 26.

FIGS. 25 and 26 show that the upper case 19 further includes a coupling tuning press portion 194 having a structure similar to that of the press portion 192, and the coupling tuning press portion 194 (FIG. 25) is installed at a portion of the lower case which is a passage structure of the cavities. The coupling tuning press portion 194 performs coupling tuning in a way similar to the tuning method for frequency tuning.

As shown in FIGS. 16 to 26, the fifth to ninth embodiments of the present invention may be formed, and at least one configuration of the embodiments may be applied to the other embodiments, including the first to fourth embodiments. For example, the depression shown in FIG. 16 may be applied to the other embodiments.

The press structure for coupling tuning shown in FIG. 25 also may be applied to the other embodiments, and the press structures of the other embodiments also may be applied for coupling tuning.

In addition, depending on certain situations, the structures according to the embodiments of the present invention may be applied to the radio frequency filter in which the cavity structures are connected by stages.

The invention claimed is:

1. A radio frequency filter comprising:

a box having a hollow interior and having a cavity formed within the hollow interior and isolated from an exterior of the box; and a resonance element located in the hollow interior of the box, wherein the box comprises a first case in which the resonance element is located and a second case covering the first case, and the first and second cases are each formed through pressing by using one mold and wherein a pin is inserted into a pin introducing hole electrically connecting the box to the resonance element to short-circuit the box and the resonance element is formed on a surface of the box facing a lengthwise tip end of the resonance element or a lengthwise tip end surface of the resonance element.

2. The radio frequency filter of claim 1, wherein the resonance element rises and protrudes from the center of the first case to be integrally formed with the first case.

3. The radio frequency filter of claim 1, wherein when the cavity structure has a structure in which a plurality of steps are connected to each other, a plurality of boxes are sequentially connected and a coupling window which is a connection passage structure is formed in the cavity structure having a sequential connecting structure.

4. A radio frequency filter comprising:

a box having a hollow interior and having a cavity formed within the hollow interior and isolated from an exterior of the box; and a resonance element located in the hollow interior of the box, wherein the box has a wrinkle structure for adjusting a spacing between a lengthwise tip end surface of the resonance element and an inner surface of the wrinkle structure disposed parallel to the tip end surface of the resonance element, and wherein a pin is inserted into a pin introducing hole electrically connecting the box to the resonance element to short-circuit the box and the resonance element is formed on a surface of the box facing a lengthwise tip end of the resonance element or a lengthwise tip end surface of the resonance element.

5. The radio frequency filter of claim 4, wherein the box comprises a first case in which the resonance element is provided and a second case covering the first case, and the first and second cases are each formed through pressing by using one mold.

6. The radio frequency filter of claim 5, wherein the resonance element protrudes from the center of the first case to be integrally formed with the first case.

7. The radio frequency filter of claim 4, wherein the wrinkle structure is formed on a surface facing a lengthwise tip end surface of the resonance element.

8. The radio frequency filter of claim 4, wherein the wrinkle structure is formed on a surface facing the widthwise tip end surface of the resonance element.

9. The radio frequency filter of claim 4, wherein the wrinkle structure is permanently transformed from an initial position to an expanded position.

10. The radio frequency filter of claim 4, wherein the wrinkle structure having a force applied from a top surface expands a wrinkle portion reducing the distance between a bottom surface of the wrinkle structure and the element.

11. The radio frequency filter of claim 4, wherein the wrinkle structure is thinner than a thickness of an adjacent surface of the lengthwise tip end surface of the resonance element.

12. The radio frequency filter of claim 4, wherein when the cavity structure has a structure in which a plurality of steps are connected to each other, a plurality of boxes are sequentially connected and a coupling window which is a connection passage structure is formed in the cavity structure having a sequential connecting structure.

13. The radio frequency filter of claim 4, wherein the box comprises a first case in which the resonance element is located and a second case covering the first case, and the wrinkle structure is formed in the second case.

14. The radio frequency filter of claim 13, wherein the wrinkle structure is formed by a plurality of recesses in the form of a closed loop which are alternately formed on an upper surface and a lower surface of the second case so as not to meet each other.

15. The radio frequency filter of claim 14, wherein at least one depression is formed in the second case near the wrinkle structure, and a plurality of dot peens are formed in the depression by external stamping equipment.

* * * * *